US005735085A

United States Patent [19]

Denooy

[11] Patent Number: 5,735,085

[45] Date of Patent: Apr. 7, 1998

[54] HINGED DOWNSPOUT

[76] Inventor: Dennis Denooy, P.O. Box 263, Montezuma, Iowa 50171

[21] Appl. No.: 638,548

[22] Filed: Apr. 26, 1996

[51] Int. Cl.[6] ..... E04D 13/08; F16L 27/00

[52] U.S. Cl. ..... 52/16; 52/11; 16/387; 16/389; 16/392; 16/339; 137/579; 137/615; 285/283

[58] Field of Search ..... 52/11, 16; 16/389, 16/390, 391, 392, 387, 365, 221, 388, 249, 252, 339, 383; 285/184, 183, 273, 283; 137/615, 357, 358, 873, 874, 579

[56] References Cited

U.S. PATENT DOCUMENTS

| | | | |
|---|---|---|---|
| 568,316 | 9/1896 | Lawrence | 16/391 |
| 702,640 | 6/1902 | Dyer | 16/391 |
| 952,059 | 3/1910 | William | 16/391 |
| 1,000,619 | 8/1911 | Miller et al. | 137/579 |
| 1,108,663 | 8/1914 | Ashman | 16/339 X |
| 1,448,646 | 3/1923 | Ward | 285/283 |
| 2,975,805 | 3/1961 | Horn | 137/615 |
| 3,060,952 | 10/1962 | Bystrom . | |
| 3,258,848 | 7/1966 | Watlington | 285/283 X |
| 3,911,954 | 10/1975 | Johnson | 285/184 X |
| 4,270,572 | 6/1981 | Jarzynka . | |
| 5,014,745 | 5/1991 | Watt . | |
| 5,335,460 | 8/1994 | Smith, Jr. | 16/389 X |
| 5,358,006 | 10/1994 | Sweers | 137/615 |
| 5,358,007 | 10/1994 | Carlberg . | |
| 5,375,891 | 12/1994 | Sicotte et al. . | |
| 5,426,822 | 6/1995 | Weir | 16/392 |
| 5,435,051 | 7/1995 | Cheremshynski . | |
| 5,452,743 | 9/1995 | Rortvedt . | |
| 5,511,829 | 4/1996 | Sicotte et al. | 52/16 X |

FOREIGN PATENT DOCUMENTS

| | | | |
|---|---|---|---|
| 1169224 | 6/1984 | Canada | 52/16 |
| 1188476 | 6/1985 | Canada | 52/16 |
| 340618 | 7/1904 | France | 16/392 |
| 489417 | 2/1919 | France | 16/390 |

*Primary Examiner*—Wynn E. Wood
*Assistant Examiner*—Laura A. Callo
*Attorney, Agent, or Firm*—Zarley, McKee, Thomte, Voorhees, & Sease

[57] ABSTRACT

The top wall of the horizontal spout section of a downspout assembly is cut away at the inlet end to create a notch such that interference with the top wall of the outlet end of the elbow section will be avoided when the horizontal section is pivoted to a lowered position. A hinge is fastened on top of the elbow and horizontal sections over the notch. The hinge includes half sections with each having oppositely disposed leg portions functioning as a saddle to straddle the elbow and horizontal sections. One of the hinge half sections includes a pair of spaced apart sleeves between which a single sleeve on the other half section is received. A bolt extends through the sleeves and draws the pair of sleeves frictionally against opposite ends of the single sleeve to lock the horizontal section in a raised over center position. A slot extends from the inner end of the one half section between the pair of sleeves to allow the pair of sleeves to be drawn together.

13 Claims, 4 Drawing Sheets

HINGED DOWNSPOUT

BACKGROUND OF THE INVENTION

Hinged downspouts of the prior art have required customized spout sections and a latch to hold the horizontal spout section in a raised position. Representative prior art downspouts are disclosed in Jarzynka, U.S. Pat. No. 4,270,572, Jun. 2, 1981; Watt, U.S. Pat. No. 5,014,745, May 14, 1991; and Sicotte et al, U.S. Pat. No. 5,375,891, Dec. 27, 1994.

The prior art downspouts are complicated and expensive to manufacture, and do not allow modification of standard in-place downspout sections to permit the horizontal section to be pivoted between raised and lowered positions.

SUMMARY OF THE INVENTION

The hinged downspout of this invention allows for the conventional in-place downspout, including a vertical section, an elbow section and a horizontal section, to be easily modified by adding a hinge between the elbow section and horizontal section. All that is required is cutting away a portion of the top wall of the horizontal section at its inlet end, in which the outlet end of the elbow section is received, to allow the horizontal section to pivot between raised and lowered positions.

The hinge which is added includes a pair of half sections, one of which is attached to the elbow section, and the other is attached to the horizontal section over the notched out top wall of the horizontal section. The notch eliminates interference between the top walls of the elbow and horizontal sections when the horizontal section is pivoted to its lowered position with the elbow section extending into the inlet end of the horizontal section.

The hinge has two additional important features that distinguish it over the prior art. The first is that oppositely disposed leg portions are provided which function as a saddle to straddle opposite sides of the elbow section and the horizontal section. This feature has two main advantages which include automatic centering of the hinge on the spout sections and providing a stronger connection between the elbow section and the horizontal section. Screws may be used to fasten the leg portions and the top hinge portion to the spout sections. The second important feature of the hinge is that it includes a pair of spaced apart sleeves on one hinge half section and a single sleeve on the other hinge half section, positioned between the pair of sleeves with a bolt extending through each of them. A slot extends from the inner end of one of the hinge half sections outwardly between the pair of sleeves, thereby allowing the sleeves to be drawn towards each other and against the single sleeve by the bolt, frictionally holding the horizontal section in its raised over center position. A wing nut is provided on the bolt which may be readily operated when raising or lowering the horizontal section.

A further important feature of the hinge is that the pair of spaced apart sleeves and single sleeve are offset outwardly to move the pivot axis as far away from the building as possible to maximize the angle of the horizontal section from the vertical section when in the raised over center position.

DESCRIPTION OF THE PREFERRED EMBODIMENT

Figure 1:
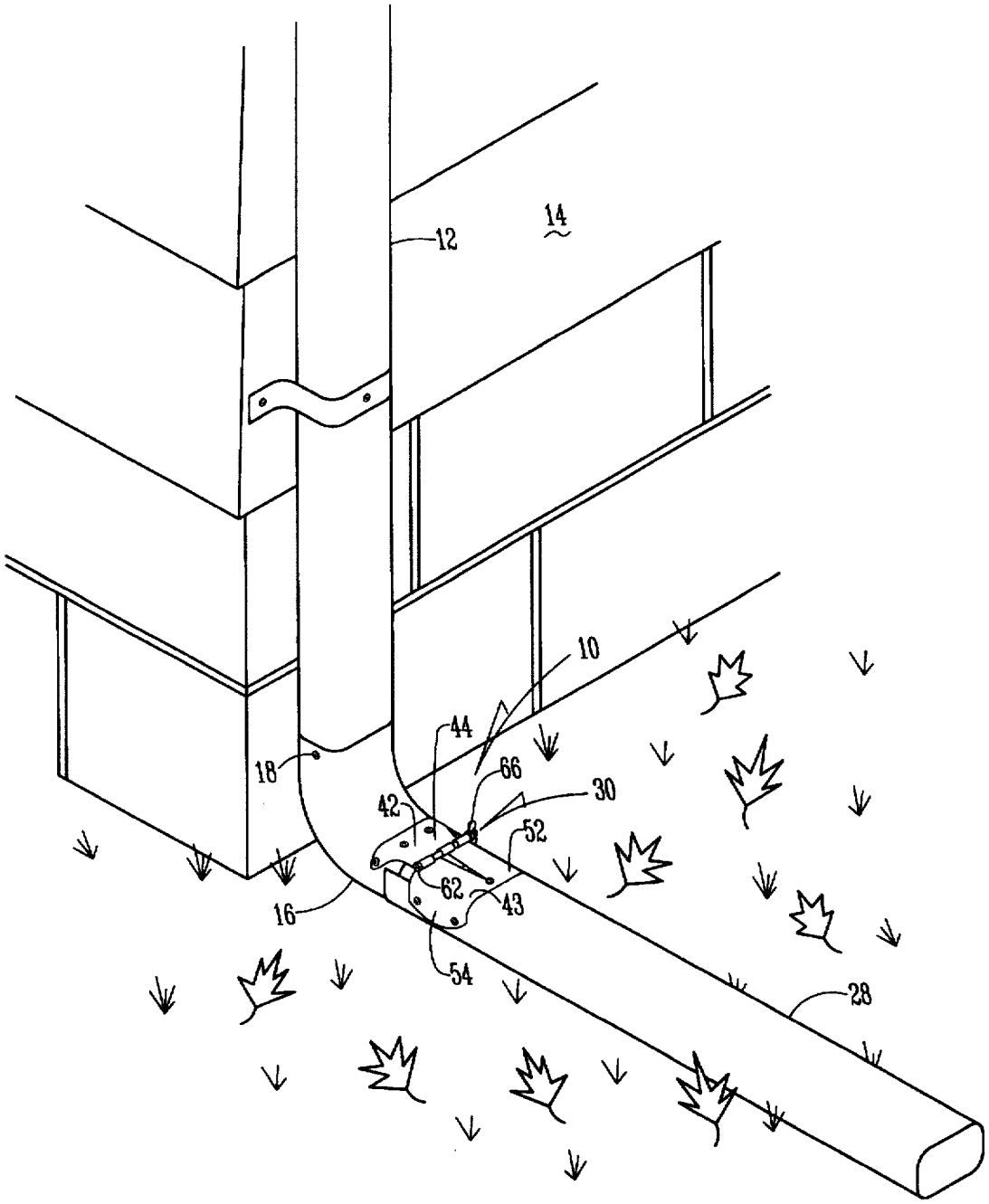
FIG. 1 is a fragmentary perspective view of the hinged downspout of this invention in its lowered position on a building.

The downspout assembly of this invention is referred to generally in FIG. 1 by the reference numeral 10 and includes a vertical downspout section 12 mounted on a house 14 and connected at its lower end to an elbow section 16 by a screw 18. The elbow section 16 has an outlet end received in the inlet end of a horizontal section 28.

Figure 2:
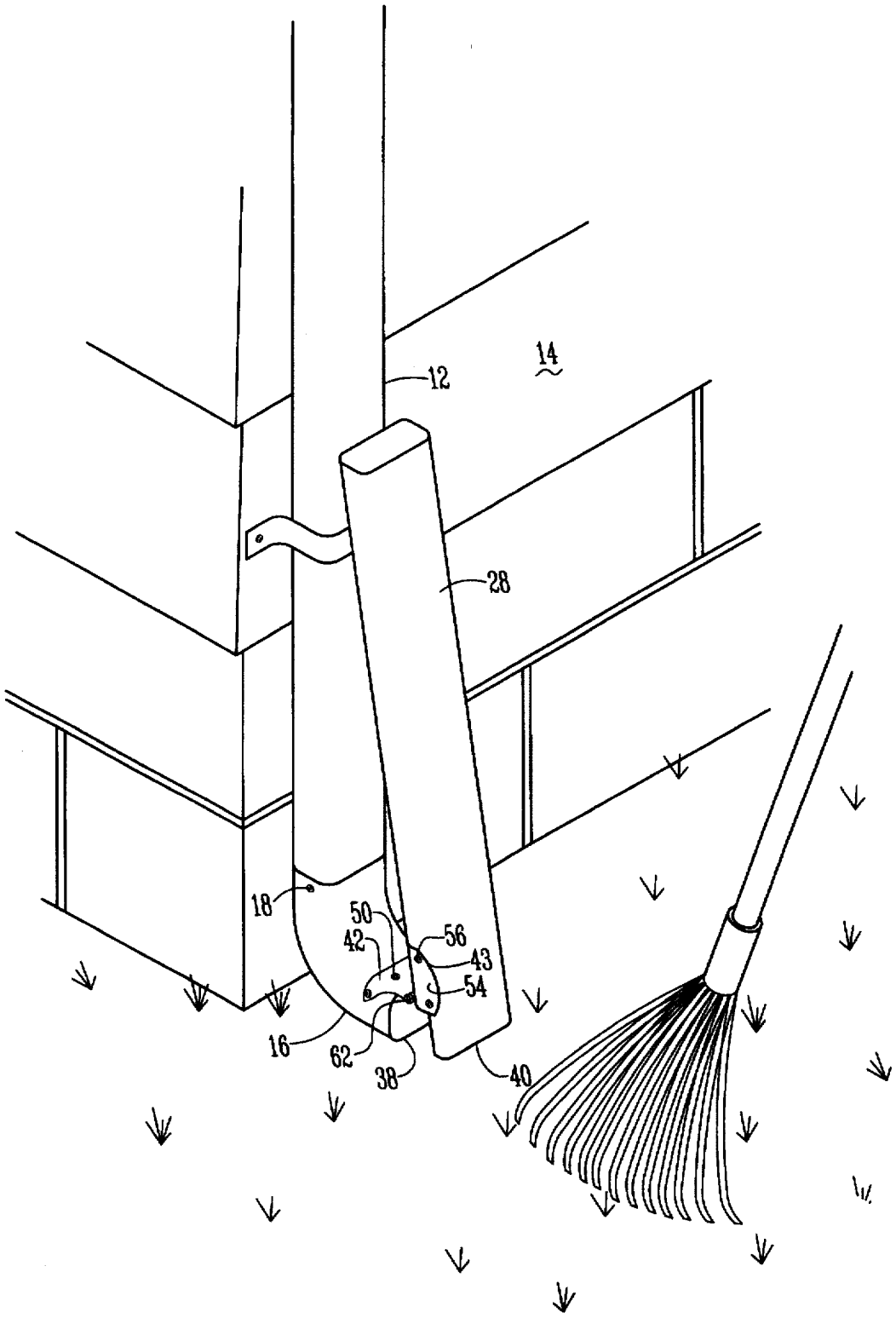
FIG. 2 is a fragmentary perspective view similar to FIG. 1 but showing the horizontal section pivoted to its raised over center out-of-use position.

The horizontal section 28 is capable of pivoting from a lowered use position of FIG. 1 to a raised inoperative position in FIG. 2 through use of a hinge 30 connecting the elbow section 16 to the horizontal section 28.

Figure 4:
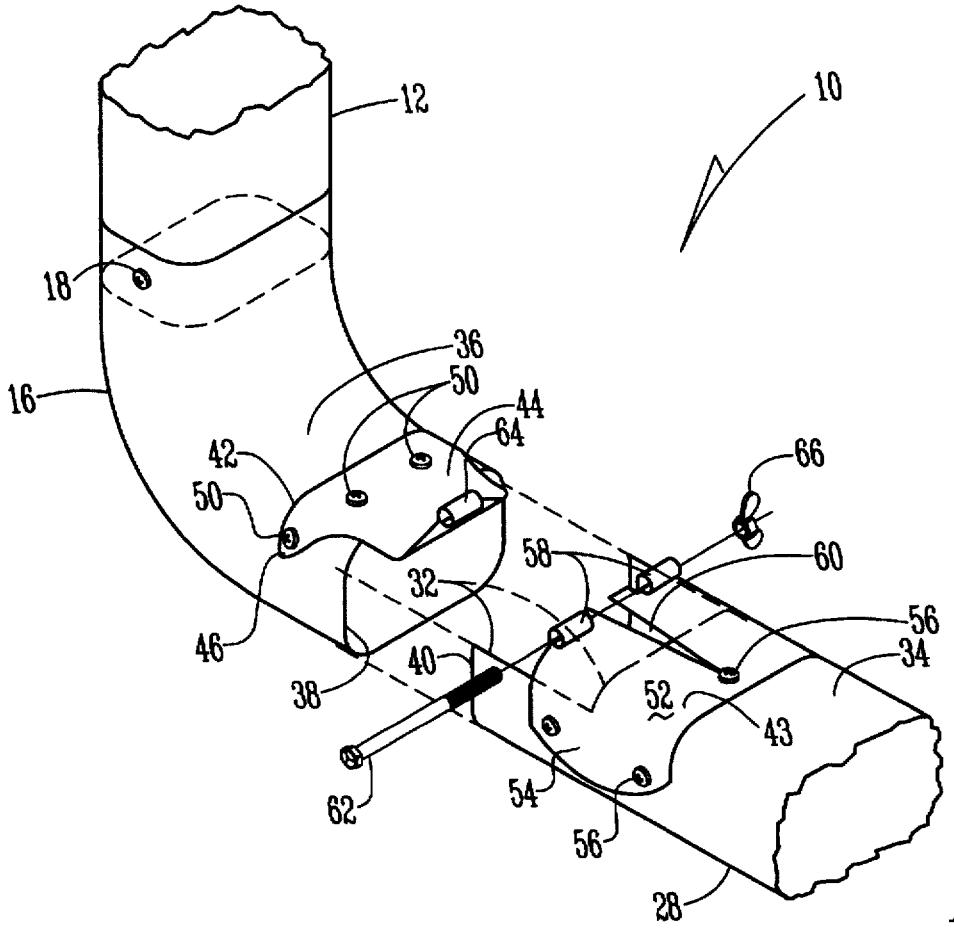
FIG. 4 is a fragmentary exploded perspective view of the hinge joint of FIG. 3.

The only modification required to standard downspout sections is to cut a notch 32 in the top wall 34 of the horizontal section 28 as seen in FIG. 4. This notch eliminates interference between the top wall 34 of the horizontal section and the top wall 36 of the elbow section when the horizontal section 28 is pivoted to its lowered position wherein the outlet end 38 of the elbow section is received in the inlet end 40 of the horizontal section.

The hinge 30 includes a pair of hinge half sections 42 and 43. The hinge half section 42 includes a top portion 44 and a pair of oppositely disposed side leg portions 46, allowing the hinge half section 42 to function as a saddle to straddle the elbow section 16. Screws 50 fasten the top portion 44 and leg portions 46 to the elbow section 16.

The hinge half section 43 on the horizontal section 28 has a top portion 52 and oppositely disposed side leg portions 54 which also function as a saddle to straddle the horizontal section 28. Screws 56 are used to secure the hinge half section 43 to the horizontal spout section 28.

Figure 3:
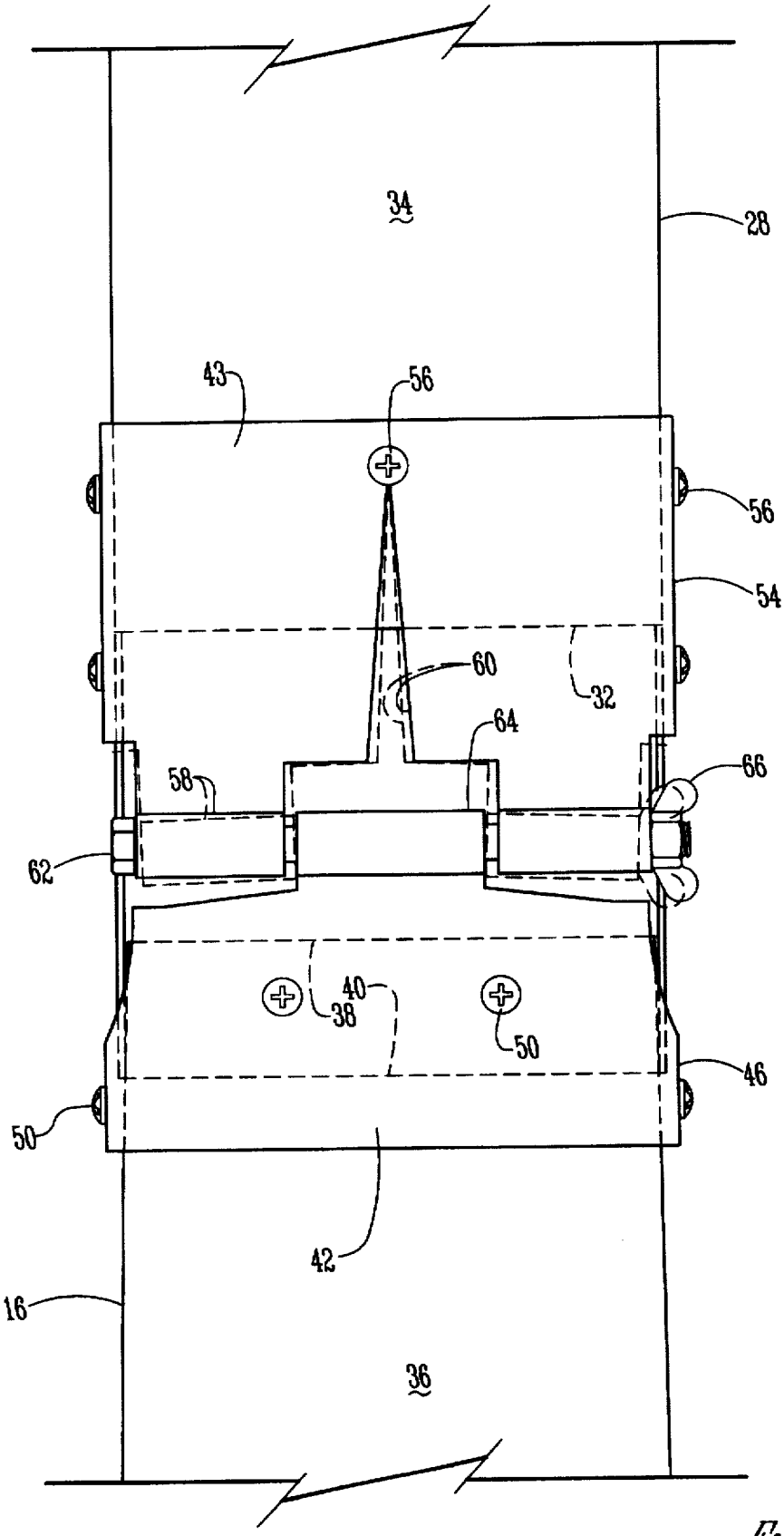
FIG. 3 is a fragmentary top plan view of the hinged joint between the outlet end of the elbow section and the inlet end of the horizontal section.

A pair of spaced apart sleeves 58 are provided on the inner end of the hinge half section 43, raised above the plane of the top portion 52. A "V" shaped slot 60 extends from the inner end of the hinge half section 43 rearwardly to allow a bolt 62 extending through the pair of sleeves 58 and a sleeve 64 on the hinge half section 43 to be drawn together against the sleeve 64. A wing nut 66 is provided on the bolt 62 to draw the sleeves 58 tight against the sleeve 64 or release them as is appropriate, as seen by the solid and dash lines in FIG. 3. The frictional resistance to pivoting created by the operation of the bolt 62, taken with the horizontal section 28 being in an over center position as seen in FIG. 2, when raised will hold the horizontal section in a raised position even when subjected to strong winds.

It is further seen that the registering pair of sleeves 58 and single sleeve 64 are not only raised above the hinge half sections but are offset outwardly away from the building in order to maximize the angle of the horizontal section 28 relative to the vertical section when pivoted to the raised position of FIG. 2.

Thus, it is seen in operation that conventional 3×4 inch or 2×3 inch spouting sections can be readily retrofitted to provide for a pivotal horizontal section. As discussed above, the only modification required is to cut a notch in the top wall of the inlet end of the horizontal section. The hinge of this invention is readily attached to the elbow and horizontal sections due to the fact that each half section of the hinge includes oppositely disposed side leg portions which function as a saddle to straddle the elbow and horizontal sections. This allows for self centering and positioning of the hinge and adds substantially to the strength of the hinge joint.

What is claimed is:

1. A hinged downspout assembly comprising, a vertical downspout section having an elbow section at its lower end, said elbow section having inlet and outlet ends, and a horizontal downspout section having an inlet end telescopically receiving the outlet end of said elbow section and pivotally connected to said elbow section, said horizontal downspout section having top and bottom walls and opposite sidewalls, said top wall terminating rearwardly of the inlet end of said horizontal downspout section to form a notched out opening in said top wall, a hinge pivotally interconnecting said elbow and horizontal downspout sections, said hinge having a pair of half sections pivotally interconnected, each of said half sections including planar top portions, one of said hinge half sections fastened to said elbow and the other hinge half section being fastened to the top wall of said horizontal downspout section, said horizontal downspout section being pivotal from a horizontal position to an over center vertical position, said hinge being positioned over said notched out opening in said top wall when said horizontal spout section is in said horizontal position, one of said planar top portions including a pair of spaced apart sleeves, the top portion of the other half section including a single sleeve positioned between said pair of sleeves, and a bolt extending through said pair of sleeves and said single sleeve, and said one planar top portion including inner and outer ends and planar half portions spaced apart at said inner end whereby operation of said bolt allows drawing said spaced planar half portions towards each other and said spaced apart sleeves into frictional engagement with opposite ends of said single sleeve to hold a horizontal downspout section in a desired position.

2. The hinged downspout assembly of claim 1 wherein top portions having oppositely disposed perpendicularly extending leg portions which function as a saddle to straddle opposite sides of said elbow and horizontal downspout sections.

3. The hinged downspout assembly of claim 2 and screw fastening means connecting said leg portions to said elbow and horizontal downspout sections.

4. The hinged downspout assembly of claim 1 wherein said pair of sleeves and said single sleeve are positioned above said planar top portion of said one half section and offset rearwardly from said inner end of said top portion of said one half section.

5. The hinged downspout assembly of claim 1 wherein said bolt includes a wing nut for operation of said bolt and engaging an end of one of said pair of sleeves.

6. The hinged downspout assembly of claim 1 wherein said spacing at the inner end of said half portions of said one top portion is defined by a slot extending from said inner end of said top portion rearwardly to adjacent said outer end.

7. The hinged downspout assembly of claim 6 wherein said slot is "V" shaped.

8. A hinged downspout assembly comprising, a vertical downspout section having an elbow section at its lower end, said elbow section having inlet and outlet ends, and a horizontal downspout section having an inlet end telescopically receiving the outlet end of said elbow section and pivotally connected to said elbow section, said horizontal downspout section having top and bottom walls and opposite sidewalls, said top wall terminating rearwardly of the inlet end of said horizontal downspout section to form a notched out opening in said top wall, a hinge pivotally interconnecting said elbow and horizontal downspout sections, said hinge having a pair of half sections pivotally interconnected, each of said half sections including planar top portions, one of said hinge half sections fastened to said elbow and the other hinge half section being fastened to the top wall of said horizontal downspout section, said horizontal downspout section being pivotal from a horizontal position to an over center vertical position, said hinge being positioned over said notched out opening in said top wall when said horizontal spout section is in said horizontal position and one of said planar top portions including a pair of spaced apart sleeves, the top portion of the other half section including a single sleeve positioned between said pair of sleeves, said pair of spaced apart sleeves and said single sleeve being positioned outwardly of the plane of said one and other top portions when in said horizontal position to maximize the distance of said horizontal downspout from said vertical downspout when in said raised over center vertical position, and a bolt extending through said pair of sleeves and said single sleeve.

9. A hinge for a downspout comprising, a pair of half sections pivotally interconnected, each of said half sections including planar top portions pivotally interconnected, said top portions having oppositely disposed perpendicularly extending leg portions adapted to function as a saddle for mounting on a downspout section with said leg portions for straddling opposite sides of the downspout section to self center said half section on the downspout section, said planar top portion of one of said half sections including a pair of spaced apart sleeves and the top portion of the other half section including a single sleeve positioned between said pair of sleeves, and a bolt extending through said pair of sleeves and said single sleeve, said one planar top portion including inner and outer ends and planar half portions spaced apart at said inner end, one of said pair of sleeves being on the inner end of each of said planar half portions whereby operation of said bolt allows drawing said spaced planar half portions towards each other and said spaced apart sleeves into frictional engagement with opposite ends of said single sleeve to hold a downspout section in a desired position, and said spacing at the inner end of said half portions of said one top portion is defined by a slot extending from said inner end of said top portion rearwardly to adjacent said outer end.

10. The hinge of claim 9 wherein said pair of sleeves and said single sleeve are positioned above said top portion of said one half section and offset rearwardly from said inner end of said top portion of said one half section.

11. The hinge of claim 9 wherein said bolt includes a wing nut for operation of said bolt and engaging an end of one of said pair of sleeves.

12. The Hinge of claim 9 wherein said slot is "V" shaped.

13. A hinge comprising, a pair of half sections pivotally interconnected, each of said half sections including planar top portions pivotally interconnected, said top portions having oppositely disposed perpendicularly extending leg portions adapted to function as a saddle, said planar top portion of one of said half sections including a pair of spaced apart sleeves and the top portion of the other half section including a single sleeve positioned between said pair of sleeves, and a bolt extending through said pair of sleeves and said single sleeve, said one planar top portion including inner and outer ends and planar half portions spaced apart at said inner end, one of said pair of sleeves being on the inner end of each of said planar half portions whereby operation of said bolt allows drawing said spaced planar half portions towards each other and said spaced apart sleeves into frictional engagement with opposite ends of said single sleeve to hold said pair of half sections in a desired position, and said spacing at the inner end of said half portions of said one top portion is defined by a slot extending from said inner end of said top portion rearwardly to adjacent said outer end.

* * * * *